US011276511B2

(12) United States Patent
Blair et al.

(10) Patent No.: US 11,276,511 B2
(45) Date of Patent: Mar. 15, 2022

(54) FIRE RESISTIVE CABLE SYSTEM

(71) Applicant: PRYSMIAN S.p.A., Milan (IT)

(72) Inventors: Ronald Blair, North Dighton, MA (US); Walter Constantine, North Dighton, MA (US); Kendall Waterman, North Dighton, MA (US)

(73) Assignee: PRYSMIAN S.p.A., Milan (IT)

( * ) Notice: Subject to any disclaimer, the term of this patent is extended or adjusted under 35 U.S.C. 154(b) by 72 days.

(21) Appl. No.: 16/072,649

(22) PCT Filed: Jan. 26, 2016

(86) PCT No.: PCT/IB2016/000198
§ 371 (c)(1),
(2) Date: Jul. 25, 2018

(87) PCT Pub. No.: WO2017/130016
PCT Pub. Date: Aug. 3, 2017

(65) Prior Publication Data

US 2019/0035515 A1 Jan. 31, 2019

(51) Int. Cl.
*H01B 3/04* (2006.01)
*H01B 7/295* (2006.01)
(Continued)

(52) U.S. Cl.
CPC ..... *H01B 7/295* (2013.01); *H01B 3/04* (2013.01); *H01B 3/36* (2013.01); *H01B 3/46* (2013.01);
(Continued)

(58) Field of Classification Search
CPC ..... H01B 3/36; H01B 3/46; H01B 7/0238; H01B 7/295; H01B 7/0283; H01B 3/04; H01B 7/29; H01B 7/292
(Continued)

(56) References Cited

U.S. PATENT DOCUMENTS 4,243,542 A * 1/1981 Mine ..... H01B 3/004 524/267
4,401,845 A * 8/1983 Odhner ..... H01B 7/295 174/113 R
(Continued)

FOREIGN PATENT DOCUMENTS

EP 0 893 801 A1 1/1999
EP 0 893 802 A1 1/1999
(Continued)

OTHER PUBLICATIONS

International Search Report from the European Patent Office in corresponding International Application No. PCT/IB2016/000198 dated Sep. 22, 2016.
(Continued)

*Primary Examiner* — Matthew D Matzek
(74) *Attorney, Agent, or Firm* — Finnegan, Henderson, Farabow, Garrett & Dunner, L.L.P.

(57) ABSTRACT

A fire-resistive cable system comprises an electrical cable housed in a fiberglass-reinforced thermosetting resin conduit. The electrical cable comprises a conductor and has only one couple of mica tapes surrounding the conductor. The couple of mica tapes are formed of a first mica tape and a second mica tape wound around the first mica tape. The mica layer of the first mica tape faces and contacts the mica layer of the second mica tape. The fiberglass-reinforced thermosetting resin conduit is made of a material comprising fibers of a glass selected from E-glass and E-CR-glass, and a resin.

8 Claims, 2 Drawing Sheets

(51) Int. Cl.

| | |
|---|---|
| ***H01B 7/29*** | (2006.01) |
| ***H01B 3/36*** | (2006.01) |
| ***H01B 3/46*** | (2006.01) |
| ***H01B 7/02*** | (2006.01) |

(52) U.S. Cl.
CPC ..... *H01B 7/0283* (2013.01); *H01B 7/29* (2013.01); *H01B 7/292* (2013.01)

(58) Field of Classification Search
USPC ..... 174/121 A, 121 R, 120 R; 428/920
See application file for complete search history.

(56) References Cited

U.S. PATENT DOCUMENTS

| | | | | |
|---|---|---|---|---|
| 5,227,586 | A * | 7/1993 | Beauchamp | H01B 7/295 174/102 R |
| 6,495,760 | B1 | 12/2002 | Castellani et al. | |
| 6,552,112 | B1 | 4/2003 | Redondo et al. | |
| 6,924,031 | B2 | 8/2005 | Redondo et al. | |
| 8,097,809 | B2 | 1/2012 | Galletti et al. | |
| 2003/0141097 | A1* | 7/2003 | Belli | H01B 3/441 174/11 OR |
| 2004/0152910 | A1 | 8/2004 | Fukuoka et al. | |
| 2007/0144764 | A1* | 6/2007 | Brambilla | H01B 3/04 174/121 R |
| 2013/0062097 | A1 | 3/2013 | Hammond et al. | |
| 2014/0008098 | A1 | 1/2014 | Scaglione et al. | |

FOREIGN PATENT DOCUMENTS

| | | | | |
|---|---|---|---|---|
| EP | 1 619 694 | A1 | 1/2006 | |
| EP | 2 682 951 | A1 | 1/2014 | |
| ER | 1 798 737 | A1 | 6/2007 | |
| FR | 2 573 910 | A1 | 5/1986 | |
| GB | 1169693 | | 11/1969 | |
| GB | 2 448 778 | A | 10/2008 | |
| GB | 2 480 452 | A | 11/2011 | |
| WO | WO 96/02920 | A1 | 2/1996 | |
| WO | WO-0074075 | A1 * | 12/2000 | H01B 7/295 |
| WO | WO 2006/005426 | | 1/2006 | |
| WO | WO-2006005426 | A1 * | 1/2006 | H01B 7/295 |

OTHER PUBLICATIONS

Written Opinion of the International Searching Authority from the European Patent Office in corresponding International Application No. PCT/IB2016/000198 dated Sep. 22, 2016.
Examination Report #1 from IP Australia in Australian counterpart application No. 2016389384, dated Sep. 25, 2020 (3 pages).
Firox® P from Cogebi brochure extract.
Von Roll's Cablosam® Tapes for Fire-Resistant Cables brochure.
Machine translation of FR2573910.
Office Action in U.S. Appl. No. 15/549,911 dated Jan. 8, 2019 (7 pages).

* cited by examiner

FIRE RESISTIVE CABLE SYSTEM

TECHNICAL FIELD

The present disclosure relates generally to a fire-resistive cable system comprising a fire resistive cable and a conduit where the cable is deployed.

BACKGROUND

Many cables, in particular cables for the transmission and/or distribution of power, may be susceptible to failure in a fire-related emergency. Many cables are not designed to sustain operation at high and/or rapidly increasing temperatures, as experienced in a fire.

The fire resistance of an electrical cable may be evaluated and certified by national and international standards. These standards generally involve testing the electrical cable to prove its capacity for operating in the presence not only of fire for a given time span, but also of water possibly coming from sprinklers or hoses.

Fire resistive cables may be evaluated for compliance with standards developed by the US certification company known as Underwriters Laboratories (UL), such as UL Standard 2196, 2012 ("UL-2196"). To obtain certification, cables are tested under fire conditions. During the test, the cables are installed in conduits, e.g., the tubing system used for protection and/or routing of the cable, and the conduits are mounted on a fire wall, e.g., a wall that restricts the spread of fire, either vertically or horizontally in accordance with the particular test. The conduits may contain multiple cables, and the cables may fill the respective conduit to no greater than 40% as according to NFPA (National Fire Protection Association) 70: National Electrical Code (NEC). The cables are tested at the maximum-rated voltage of the cable or the utilization voltage of the cable, and remain energized throughout the test. Temperature rise and fire conditions are prescribed. After the test, the cables are de-energized, and the wall is hosed down to determine the structural integrity of the installed system. After the hose stream is stopped and usually after drying, the cables are re-energized to assess the electrical integrity of the cables.

The cable/conduit systems that pass the test are certified in a given configuration. For example, if a conduit with a 14% conduit fill passes the test, but does not pass the test with a 32% conduit fill, then only the conduit with the 14% conduit fill is certified. However, when a cable/conduit system passes the test with a given conduit fill, it is certified also for lower conduit fills.

For passing the tests, the conduit should be fire-resistive. Typically, fire-resistive conduits are made of steel or of specifically designed fiberglass-reinforced resins.

Certification under UL-2196 may involve a one-hour test or a two-hour test. In 2012, research conducted by UL showed that some products and systems similar to those previously certified under UL-2196 could no longer consistently pass the two-hour fire wall test. UL initiated an interim program with more stringent revised guidelines for certification.

One method of improving the high temperature performance of a cable includes providing the cable with an extruded covering formed of one or more heat resistant materials. The extruded coverings may incorporate fillers to increase heat resistance.

Another method of improving the high temperature performance of a cable includes providing the cable with mica tape, as defined in the following, made with glass fibers on one side of the mica tape and mica flakes on the opposite side of the mica tape. The mica tape is wrapped around a conductor during production, and one or more outer layers are applied over the layer of mica tape. Upon being exposed to increasing temperatures, the outer layers may degrade and fall away, but the glass fibers may hold the mica flakes in place.

Mica tape manufacturers typically instruct users to apply the mica tape with the mica side facing the conductor. For example, the brochure from Cogebi Inc. for Firox® P discloses a tape made of phlogopite mica paper bonded to an electrical grade glass cloth as the supporting fabric and impregnated with a high temperature resistant silicone elastomer. The brochure discloses that the tape is applied over a conductor with the mica side facing the conductor to act as electrical insulation in the event of fire.

Also, the brochure from Von Roll Switzerland Ltd for Cablosam® 366.21-30 discloses a flexible muscovite Samica® tape impregnated with a silicone resin and reinforced with woven glass. The woven glass forms a backing surface. The brochure discloses that the tapes are applied onto the bare wire strand always with the woven glass to the outside after application. Thus, the brochure describes that the tape is applied to the conductor with the mica side facing the conductor.

European Publication EP 1 798 737 (EP '737) discloses an electric cable including a plurality of electrically conductive wires, on each of which is applied a layer comprising a glass fiber strip with a mica layer glued thereon. EP '737 applies a single mica layer and does not disclose which side of the layer with the glass fiber strip and the mica layer faces the conductive wires.

PCT International Publication WO 96/02920 (WO '920) discloses a cable including two layers of glass-cloth-backed mica tape applied over a wire conductor. WO '920 discloses that the mica tapes layers are applied with the glass cloth on the outside of the layer, and therefore that the mica side faces the conductor.

European Publication EP 1 619 694 (EP '694) discloses a cable including a conductor on which two layers of tape including glass cloth adhesively coated on one side with mica is applied. EP '694 discloses that each layer is applied with the mica side facing the conductor.

French Publication FR 2 573 910 (FR '910) discloses an insulating layer for electric cables with dielectric and insulating characteristics over a large temperature range. This layer comprises one or more mica layers obtained by helicoidally wrapping one or more tapes made of a glass fabric impregnated by an adhesive supporting mica particles. The mica surface with mica particles is preferably provided facing the structure to be protected. The manufacturing process provides for helicoidally wrapping a first mica tape around the element to be protected by positioning the surface with mica particles to face the element to be protected; and a second mica tape is superposed on the first one with the face covered with mica particles inwardly turned, but with a rotation direction opposite to that of the first tape. All of the mica tapes used have the respective mica surfaces facing the conductors.

The Applicant faced the problem of providing a fire-resistive cable suitable for complying with national and international standards and comprising a limited number of mica layers.

The number of layers of mica tape may affect the weight and size of the cable, and also the cost and time to manufacture the cable, therefore a limited number of mica layers is sought.

SUMMARY

The Applicant has found that it is possible not only to provide a compliant fire-resistive cable with a limited number of mica tapes, but also to improve the fire-resistive performance of the cable by using mica tapes only wound around the cable conductor with the respective mica surfaces facing each other, when the cable is deployed in a conduit made of suitable fiberglass-reinforced resin.

Without wishing to be bound to a theory, the Applicant perceived that when the mica tape are applied with the respective mica surfaces facing towards the conductor, mica particles may break loose during manufacturing and/or cable deployment, thus weakening the fire barrier performance of the mica tape.

The Applicant observed that a fiberglass-reinforced thermosetting resin conduit is less thermally and electrically conductive than a metallic (steel) conduit.

By providing a cable system with one single pair, or couple, of mica tapes such that the respective mica surfaces face each other in a so-called "mica sandwich" configuration, and by deploying a cable so featured in a fiberglass-reinforced thermosetting resin conduit, the Applicant found that the cable exhibits an outstanding fire resistance and structural integrity under high temperatures, and the mica tapes provide effective protection for the conductor to maintain its electrical circuit integrity performance. The cable system has been found suitable for obtaining certification under the UL-2196 interim program.

In one aspect, the present disclosure is directed to a fire-resistive cable system comprising an electrical cable housed in a fiberglass-reinforced thermosetting resin conduit. The electrical cable comprises a conductor and has one couple of mica tapes only surrounding the conductor. The couple of mica tapes is formed of a first mica tape and a second mica tape wound around the first mica tape, both the tapes including a mica layer attached to a backing layer. The mica layer of the first mica tape faces and contacts the mica layer of the second mica tape. The electrical cable further includes at least one insulation layer surrounding the second mica tape. The fiberglass-reinforced thermosetting resin conduit is made of a material comprising fibers of a glass selected from E-glass and E-CR-glass, and a resin.

In the present description and claims, by "mica tape" is meant a tape comprising a layer of mica flakes attached to a backing layer. The mica layer is typically formed of one or more types of mica flakes (e.g., muscovite and/or phlogopite), arranged to form a mica paper or sheet. The mica layer is generally impregnated or coated with a binding agent (e.g. silicone resin or elastomer, acrylic resin, and/or epoxy resin). The backing layer is formed of a supporting fabric (e.g., woven or unwoven glass). The mica layer is generally bonded to the backing layer by the same binding agent.

In the present description and claims, an "E-glass" is as established by ASTM D578/D578M (2011), for example an alumino-silicate glass with less than 1% w/w alkali oxides and optionally containing boron.

In the present description and claims, an "E-CR-glass" is as established by ASTM D578/D578M (2011), for example an Electrical/Chemical Resistance glass made of alumino-lime silicate with less than 1% w/w alkali oxides.

The resin of the conduit is preferably a phenolic resin.

In the present description and claims, "insulation layer" is used herein to refer to a covering layer made of a material having electrically insulating properties, for example, having a dielectric strength of at least 5 kV/mm, preferably greater than 10 kV/mm.

The fire-resistive system can comprise one or more electric cables as described above within a fiberglass-reinforced thermosetting resin conduit.

The cable system can have a conduit fill (the percentage of a section of the conduit that is filled by the cable/s) up to 25% for 2-hour vertical rated cables and up to 35% for 2-hour horizontal rated cables.

In the present description and claims, as "vertical rated" it is meant a cable system passing a fire-resisting test in vertical lay conditions, and as "horizontal rated" it is meant a cable system passing a fire-resisting test in horizontal lay conditions.

For the purpose of the present description and of the appended claims, except where otherwise indicated, all numbers expressing amounts, quantities, percentages, and so forth, are to be understood as being modified in all instances by the term "about." Also, all ranges include any combination of the maximum and minimum points disclosed and include any intermediate ranges therein, which may or may not be specifically enumerated herein.

DESCRIPTION OF THE EMBODIMENTS

Reference will now be made in detail to the present exemplary embodiments, an example of which is illustrated in the accompanying drawing. The present disclosure, however, may be embodied in many different forms and should not be construed as limited to the embodiments set forth herein.

Figure 1:
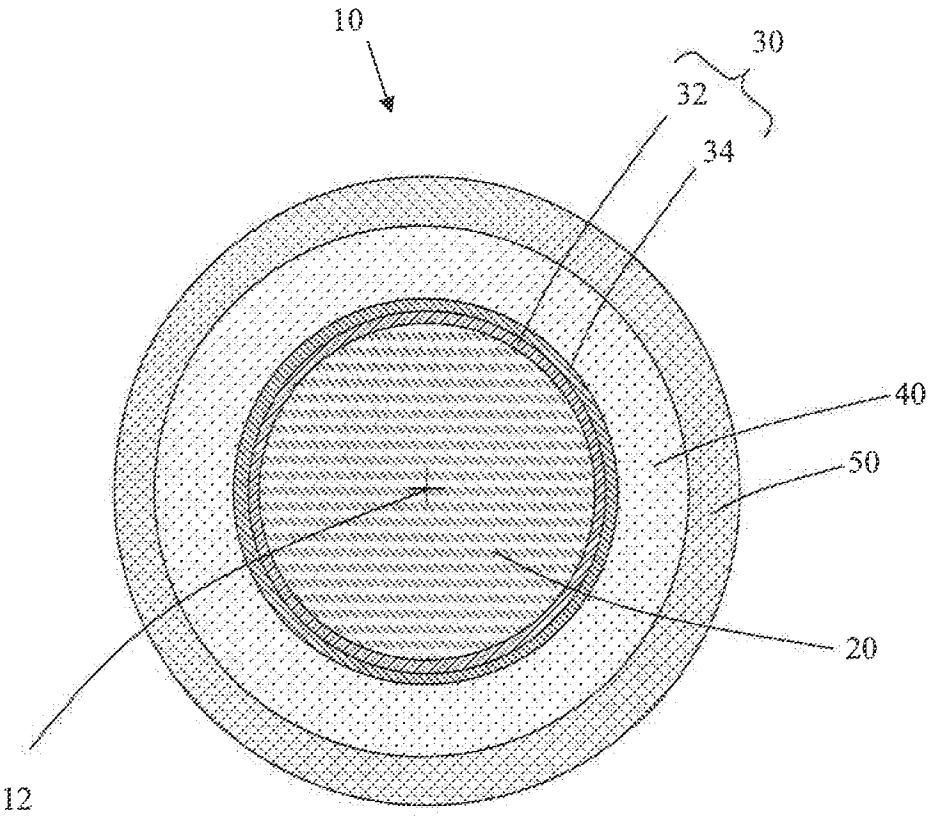
FIG. 1 is a cross-sectional view of an electrical cable, consistent with certain disclosed embodiments.

Referring now to FIG. 1, an electrical cable 10 has a longitudinal axis 12. The electrical cable 10 includes, in order from the interior to the exterior, an electrical conductor 20, a couple of mica tapes 30, and one or more layers sequentially provided in radial external position with respect to the couple of mica tapes 30*a*. Such external layer(s) include a first insulation layer 40 and a second insulation layer 50. In some applications, an outer sheath (not illustrated) surrounding and, optionally, contacting the second insulating layer 50 can be present.

The conductor 20 is made of an electrically conducting metal, preferably copper or copper alloy. Although shown in FIG. 1 as a single element, the conductor 20 may be either solid or made of stranded wires. For example, the conductor 20 may be 8 AWG (American wire gauge) (8.36 $mm^2$) 7-strand compressed soft bare copper in accordance with the standards identified by ASTM International as ASTM B8 Class B concentric-lay-stranded copper conductors. The conductor 20 may also range in size from about 2 $mm^2$ (14 AWG) to about 500 $mm^2$ (1000 kcmil).

The couple of mica tapes 30 is wound around the conductor 20. The couple of mica tapes 30 includes a first mica tape 32 and a second mica tape 34. The first mica tape 32 is disposed around the conductor 20 such that the first mica tape 32 contacts and is applied directly onto the conductor 20. The second mica tape 34 is disposed around the first mica tape 32 such that the second mica tape 34 contacts and is applied directly onto the first mica tape 32.

Each of the first mica tape 32 and the second mica tape 34 are formed of a mica layer attached to a backing layer.

The first mica tape 32 is wound onto the conductor 20 such that the backing layer of the first mica tape 32 faces and contacts the conductor 20, and the mica layer of the first mica tape 32 faces away from the conductor 20. Thus, the backing layer of the first mica tape 32 faces radially inward toward the axis 12 of the cable 10, and the mica layer of the first mica tape 32 faces radially outward away from the axis 12 of the cable 10.

The second mica tape 34 is wound onto the first mica tape 32 such that the mica layer of the second mica tape 34 faces and contacts the mica layer of the first mica tape 32, and the backing layer of the second mica tape 34 faces away from the conductor 20 and the first mica tape 32. Thus, the mica layer of the second mica tape 34 faces radially inward toward the axis 12 of the cable 10, and the backing layer of the second mica tape 34 faces radially outward away from the axis 12 of the cable 10.

In embodiments in which the conductor 20 is made of stranded wires, the first mica tape 32 is preferably wound in an opposite winding direction than the stranding direction of the conductor 20 wires. Advantageously, the second mica tape 34 is wound in a winding direction opposite to the winding direction of the first mica tape 32. The opposite winding direction of the first and second mica tapes 32 and 34 assists in keeping the torque on the conductor 20 minimized so that twisting of the conductor 20 during exposure to fire can be minimized.

For example, the first mica tape 32 may have a right hand winding direction or lay (RHL), and the conductor 20 (or at least an outer layer of wires contained therein) and the second mica tape 34 may have a left hand winding direction or lay (LHL), or vice versa. This lay of the mica tapes minimizes the torsion effect due to the mica tapes winding.

Alternatively, both the first mica tape 32 and the second mica tape 34 may have, for example, a RHL, and the conductor 20 may have a LHL. With this winding configuration, the first and second mica tapes 32 and 34 exert a joined torque resistance, opposed to the torsion due to the conductor 20 winding.

The first mica tape 32 and the second mica tape 34 are wound at an angle of from 30° to 60°, preferably of about 45°. Further, the first mica tape 32 and the second mica tape 34 both have an overlap percentage (e.g., the percentage of the width of the mica tape overlapping onto itself during winding) such that no gaps in the winding of the mica tapes are formed both during manufacturing and deployment of the cable 10. The overlap percentage can be, for example, of 25%.

The mica layer of one or more of the mica tape 32, 34 preferably have dimensions (thickness and width) such that the tapes can be applied around the conductor 20 minimizing wrinkles and folds as much as possible. Wrinkles and folds may potentially cause the mica tapes to be vulnerable to damage. For example, the mica layer of one or both of the mica tapes 32, 34 has a nominal thickness of 0.005 inches (0.127 mm) and a nominal width of approximately 0.5 inches (12.7 mm). The term "thickness" used herein refers to the dimension of the mica tape extending radially with respect to the axis 12 of the cable 10 when the mica tape is applied to the cable 10. The term "width" used herein refers to the dimension of the mica tape orthogonal to the thickness and to the application direction of the mica tape.

The layers sequentially provided in radial external position with respect to the couple of mica tapes 30, e.g., the first insulation layer 40 and/or the second insulation layer 50, are preferably extruded onto the couple of mica tapes 30. The first insulation layer 40 and/or the second insulation layer 50 may be formed of compounds that emit less smoke and little or no halogen when exposed to high sources of heat, e.g., low smoke zero halogen (LS0H) compounds, and that have low toxicity flame retardant properties.

In the embodiment shown in FIG. 1, the first insulation layer 40 surrounds the second mica tape 34 such that the first insulation layer 40 contacts and is applied directly onto the second mica tape 34. The first insulation layer 40 has a nominal thickness selected according to the requirement of national or international standards, generally on the basis of the conductor size. The thickness of the first insulation layer 40 may be, for example, at least 0.045 inches (1.143 mm).

The first insulation layer 40 may be formed of a silicone-based compound, such as a silicone-based rubber. The silicone-based rubber may form a matrix incorporating at least one mineral flame-retardant filler, e.g., to protect the material of the first insulation layer 40 during manufacturing and installation of the cables within the conduit. The mineral fillers cab be incorporated into the silicone-based compound by using a bonding agent, such as silane, and the silicone-based compound may be cured using a cure catalyst, such as peroxide.

At higher temperatures experienced during fire conditions, e.g., at temperatures of greater than or equal to approximately 600° C., the silicone-based compound may form silicon dioxide ash. At these higher temperatures, the silicon dioxide ash formed by the first insulation layer 40 and the mica tapes of the couple 30 may link and form a continuous eutectic mixture that serves as a dielectric for the cable 10 to allow the cable 10 to continue operating.

Alternatively, the silicone-based compound may be a ceramifiable polymer that ceramifies at higher temperatures experienced during fire conditions, e.g., at temperatures of approximately 600° C. to 900° C. At these higher temperatures, the ceramifiable polymer change from a flexible rubber-like material to a more solid, ceramic-like material.

The second insulation layer 50 surrounds the first insulation layer 40 such that the second insulation layer 50 contacts and is applied directly onto the first insulation layer 40. The second insulation layer 50 may have a nominal thickness as prescribed by the relevant national or international standards.

The second insulation layer 50 may be formed of a thermoplastic polymer or of a thermosetting polymer. For example, the second insulation layer 50 may be formed of a polyolefin, an ethylene copolymer (e.g., ethylene-vinyl acetate (EVA) or linear low density ethylene (LLDPE)), and/or a mixture thereof. Examples of polymers or polymeric mixtures suitable for the second insulation layer 50 are described in U.S. Pat. Nos. 6,495,760, 6,552,112, 6,924,031, 8,097,809, EP0893801, and EP0893802.

The polymer of the second insulation layer 50 is added with a non-halogen, inorganic flame retardant filler, such as magnesium hydroxide and/or aluminum hydroxide in an amount suitable to confer flame-retardant properties to the second insulation layer 50 (for example from 30 wt % to 70 wt % of inorganic flame retardant filler with respect to the total weight of the polymeric mixture).

The cable 10 constructed as described above may be used in various conditions, such as the conditions specified for a Type RHW-2 cable in the National Electrical Code® (NEC®). The cable 10 may have a voltage rating of from 400 to 600 volts and may be fire rated at from 400 to 600 volts.

Figure 2:
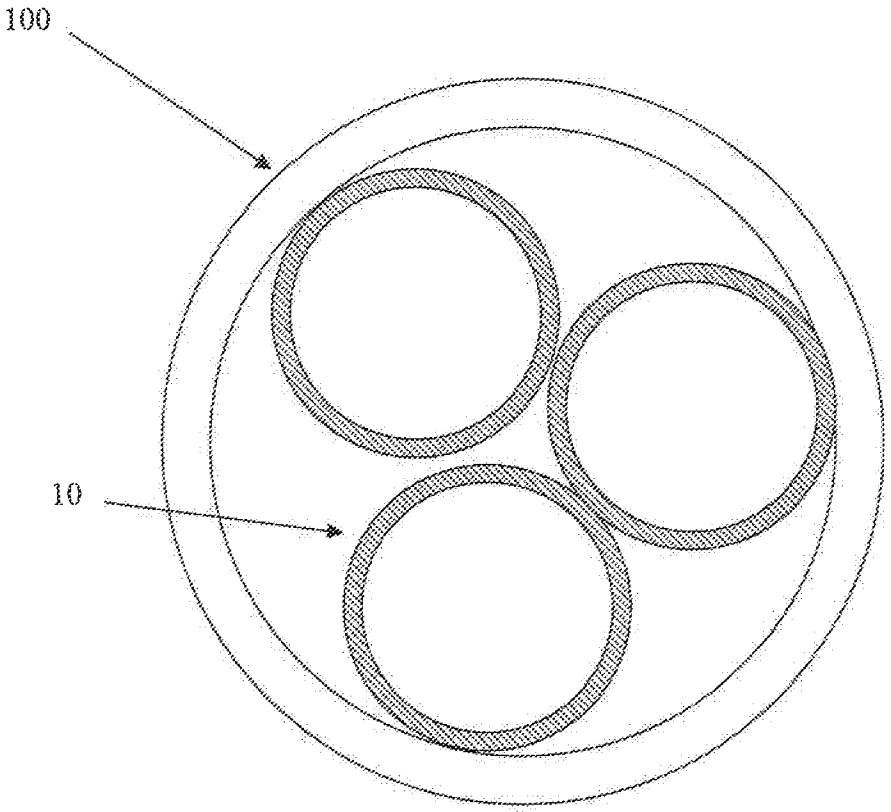
FIG. 2 is a view of a fire-resistive cable system consistent with certain disclosed embodiments

One or more of the cables 10 may be deployed in a conduit 100 according to FIG. 2, where three cables 10 are illustrated. The cross-section of conduit 100 is circular, though other shapes can be envisaged.

In the fire-resistive cable system, the fittings typically associated to the conduit are preferably made of a fiberglass-reinforced thermosetting resin, too.

The conduit fill, i.e. the percentage of the hollow section of the conduit that is filled by the cable 10, may be up to 25% for 2-hour vertical rated cables and up to 35% for 2-hour horizontal rated cables, but it is understood that the conduit fill may also be less than these values. For a conduit including four of the cables 10 with 17% fill, the nominal diameter of the conduit may be approximately 1.5 inches (38.10 mm), the outer diameter of the conduit may be approximately 1.74 inches (44.20 mm), and the inner diameter of the conduit may be approximately 1.61 inches (40.89 mm). For a conduit including four size 8AWG cables 10 with 27% fill, the nominal diameter of the conduit may be approximately 1.0 inches (25.4 mm), the outer diameter of the conduit may be approximately 1.683 inches (42.75 mm), and the inner diameter of the conduit may be approximately 1.183 inches (30.05 mm). It is understood that the diameters may be greater than or less than these values.

The cable is suitable for passing stringent fire resistive testing that challenges the capacity of the cable to carry current in the presence of fire and of water.

While mica tape manufacturers may typically recommend that the mica surface of the mica tape face and/or be in contact with the conductor, the Applicant has found to the contrary that it is more effective for improving fire resistance to sandwich together the mica layers of two adjacent mica tapes. Sandwiching the mica layers could assure the integrity of the mica layers which, together with the deployment in a fiberglass-reinforced thermosetting resin conduit, allows the cable to resist higher temperatures, thereby improving the fire resistance of the cable, and therefore protecting the electrical performance of the electrical conductor.

The system comprises a cable including one couple of mica tapes, and such a construction may be sufficient for various sizes of the cable to pass fire wall tests when tested both in vertical and in horizontal configuration, when the cable is deployed in a fiberglass-reinforced thermosetting resin conduit.

Example

A number of cable/conductor systems according to the disclosure and comparative cable/conductor systems have the construction features according to Table 1.

Systems alphanumerically named are comparative. "Mica facing" refers to the directions that the mica layers of the mica tapes are facing. For example, "up/down" means that there is one couple of mica tapes including one mica tape with the mica layer facing up (away from the conductor) and one mica tape with the mica layer facing down (towards the conductor) such that the mica layers are sandwiched together. "Up/down (×2)" means that there are two couples of mica tapes with each couple having the "up/down" orientation. "Down/down" means that there is one couple of mica tapes, and the mica layer of each mica tape faces down (towards the conductor).

"Mica tape winding direction" refers to the winding direction of the mica tapes. "Up=RHL" means that the mica tape with the upward-facing mica layer has RHL, "down=LHL" means that the mica tape with the downward-facing mica layer has LHL, and "down=RHL" means that the mica tape with the downward-facing mica layer has RHL.

All of the cables of Table 1 were Type RHW-2 cable having a voltage rating of 600 volts and a fire rating of 480 volts includes 8 AWG (8.36 mm2) 7-strand compressed soft bare copper in accordance with ASTM B8 Class B concentric-lay-stranded copper conductors. Layers of mica tape (Cablosam® 366.21-30 from Von Roll Switzerland Ltd) having a nominal thickness of approximately 0.005 inches (0.127 mm) and a nominal width of approximately 0.5 inches (12.7 mm) are applied on top of the conductor.

All of the cables of Table 1 had an insulating layer of LS0H low toxicity flame retardant silicon insulation applied over the mica tape(s), and a polymeric flame retardant layer of LS0H low toxicity flame retardant polyolefin (UNIGARDTM RE HFDA-6525 from The Dow Chemical Company) applied over the insulating layer.

The systems of Table 1 were tested according to 2-hour Horizontal and 2-hour Vertical UL-2196 test as from Table 2. Table 2 also reports the outcome of such tests.

TABLE 1

| | System | | | | | | | | |
|---|---|---|---|---|---|---|---|---|---|
| Cable | 1 | 2 | 3 | 4 | 1A | 1B | 2A | 2B | 2C |
| Conductor Size | 750 MCM (380 $mm^2$) | 8AWG (8.36 $mm^2$) | 500 KCM (253.35 $mm^2$) | 250 KCM (126.67 $mm^2$) | 750 MCM (380 $mm^2$) | 750 MCM (380 $mm^2$) | 8AWG (8.36 $mm^2$) | 8AWG (8.36 $mm^2$) | 8AWG (8.36 $mm^2$) |
| Number of Mica Tapes | 2 (1 couple) | 2 (1 couple) | 2 (1 couple) | 2 (1 couple) | 4 (2 couples) | 2 (1 couple) | 4 (2 couples) | 2 (1 couple) | 2 (1 couple) |
| Mica Tape Overlap | 25% | 25% | 25% | 25% | 25% | 25% | 25% | 25% | 25% |
| Mica Facing | up/down | up/down | up/down | up/down | up/down (x2) | up/down (x2) | up/down (x2) | up/down | down/down |
| Mica Tape Winding Direction | up = RHL down = LHL | up = RHL down = RHL | up = RHL down = RHL | up = RHL down = RHL | up = RHL down = LHL | up = RHL down = LHL | up = RHL down = LHL | up = RHL down = RHL | down = RHL down = RHL |
| Conduit | FRE | FRE | FRE | FRE | EMT | EMT | EMT | EMT | EMT |
| No. of cables in conduit | 2 | 4 | 2 | 3 | 2 | 2 | 4 | 4 | 4 |

FRE = fiberglass-reinforced thermosetting resin conduit (extra heavy wall Breathsaver ® by FRE Composites ®)

EMT = zinc-free steel conduit (by Allied Tube and Conduit ®)

TABLE 2

| | System | | | | | | | | | | | | | | | | |
|---|---|---|---|---|---|---|---|---|---|---|---|---|---|---|---|---|---|
| | 1 | | 2 | | 3 | | 4 | | 1A | | 1B | | 2A | | 2B | | 2C |
| Conduit Position | V | H | V | H | V | H | V | H | V | H | V | H | V | H | V | H | V |
| Conduit Fill (%) | 21 | 28 | 16 | 27 | 20 | 27 | 14 | 33 | 19 | 32 | 18 | 30 | 17 | 40 | 14 | 34 | 21 |
| +/− | + | + | + | + | + | + | + | + | + | + | − | + | + | + | − | + | − |

"Conduit position" refers to the mounting orientation of the conduit on the fire wall, i.e., vertical ("V") or horizontal ("H").
The positive (+) and negative (−) signs indicate, respectively, that the system passed or not passed the test.

As shown in Table 2, all of the cable systems according to the disclosed features passed the 2 hours fire-test both in vertical and horizontal conditions, thus demonstrating the fire resistance of a cable having one single couple of mica tape in "sandwich" configuration housed in a fiberglass-reinforced thermosetting resin conduit.

When a metal (steel) conduit is used for housing the electric cable, only cables with two couples of mica tape in "sandwich" configuration pass the 2 hours fire-test both in vertical and horizontal conditions.

In particular, System 1A, having the same conductor size of System 1, but two couples of mica tapes and a conduit made of steel, passed both the 2-hour Horizontal and 2-hour Vertical tests by virtue of said additional mica tapes. It should be noted that the conduit fill of the vertical test is lower than that of System 1, accordingly such system with a cable with four mica tapes in a steel conduit can be certified for less conduit fills.

System 1B, having the same conductor size and mica tapes number of System 1, but a conduit made of steel, passed the 2-hour Horizontal test only, but in vertical configuration it lasted 1 hour only, accordingly such system with a steel conduit cannot be 2-hour vertical rated.

System 2A having the same conductor size of System 2, but two additional mica tapes and a conduit made of steel, passed both the 2-hour Horizontal and 2-hour Vertical tests by virtue of said additional mica tapes. It should be noted that the conduit fill of the vertical test is lower than that of System 2, accordingly such system with a cable with four mica tapes in a steel conduit can be certified for less conduit fills.

System 2B having the same conductor size and mica tapes number of System 2, but a conduit made of steel, passed the 2-hour Horizontal test only, but in vertical configuration it lasted 1 hour only, accordingly such system with a steel conduit cannot be 2 hour vertical rated.

It will be apparent to those skilled in the art that various modifications and variations can be made to the structure of the cable disclosed herein without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. A fire-resistive cable system comprising an electrical cable housed in a fiberglass-reinforced thermosetting resin conduit, wherein the electrical cable comprises a conductor and has one couple of mica tapes surrounding the conductor, the couple of mica tapes being formed of a first mica tape and a second mica tape wound around the first mica tape, each of the first and the second mica tape including a mica layer attached to a backing layer, and the mica layer of the first mica tape faces and contacts the mica layer of the second mica tape; and wherein the first fiberglass-reinforced thermosetting resin conduit is made of a material comprising fibers of a glass selected from E-glass and E-CR-glass, and a resin; and wherein the first mica tape is wound in a winding direction that is opposite to a winding direction of the second mica tape.

2. Fire-resistive system of claim 1, wherein the electrical cable further comprises at least one insulation layer surrounding the couple of mica tapes.

3. Fire-resistive system of claim 2, wherein the electrical cable further comprises a first insulation layer and a second insulation layer.

4. Fire-resistive system of claim 3, wherein the first insulation layer is formed of a silicone-based compound.

5. Fire-resistive system of claim 4, wherein the silicone-based compound includes a silicone-based rubber forming a matrix with a flame-retardant mineral filler incorporated into the matrix.

6. Fire-resistive system of claim 4, wherein the second insulation layer is made of a flame-retardant polymer.

7. Fire-resistive system of claim 1, wherein the resin of the conduit is a phenolic resin.

8. Fire-resistive cable system of claim 2, wherein the at least one insulation layer contacts and is applied directly onto the second mica tape.

* * * * *